US006453852B1

(12) United States Patent
Lifshits et al.

(10) Patent No.: US 6,453,852 B1
(45) **Date of Patent: *Sep. 24, 2002**

(54) TEMPERATURE STRATIFIED SUPERHEATER AND DUCT BURNER

(75) Inventors: Vladimir Lifshits, Redwood City; Martin Joseph Fry, Robin Whipple Way, both of CA (US)

(73) Assignee: Corn Company, Inc., Burlingame, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/602,600

(22) Filed: Jun. 22, 2000

Related U.S. Application Data

(60) Provisional application No. 60/206,459, filed on May 22, 2000.

(51) Int. Cl.[7] ..... F22D 1/08

(52) U.S. Cl. ..... 122/7 R; 122/367.3

(58) Field of Search ..... 122/7 R, 367.3, 122/367.1; 165/162, 135, 146

(56) References Cited

U.S. PATENT DOCUMENTS

| | | | | | |
|---|---|---|---|---|---|
| 2,006,649 | A | * | 7/1935 | Modine | 165/146 |
| 3,442,324 | A | | 5/1969 | Clay, Jr. et al. | 165/38 |
| 3,443,550 | A | * | 5/1969 | May et al. | 122/7 R |
| 3,677,338 | A | * | 7/1972 | Staub | 165/146 |
| 4,416,223 | A | * | 11/1983 | Hashizume | 165/146 |
| 4,555,902 | A | | 12/1985 | Pilaeczyik | 60/39.5 |
| 4,737,100 | A | | 4/1988 | Schnell et al. | 431/3 |
| 5,461,853 | A | | 10/1995 | Vetterick | 60/39.02 |
| 5,482,009 | A | * | 1/1996 | Kobayashi et al. | 122/367.1 |
| 5,678,401 | A | | 10/1997 | Kimura | 60/39.182 |
| 5,946,901 | A | | 9/1999 | Bauver et al. | 60/39.182 |
| 6,167,846 | B1 | * | 1/2001 | Ogino et al. | 122/367.3 |

FOREIGN PATENT DOCUMENTS

| | | |
|---|---|---|
| SU | 916886 | 7/1980 |

* cited by examiner

*Primary Examiner*—Jiping Lu
(74) *Attorney, Agent, or Firm*—Townsend and Townsend and Crew LLP

(57) ABSTRACT

A heat recovery system includes an upstream superheater section and a duct burner arranged to provide improved performance. The upstream superheater section and duct burner are arranged to reduce the negative effects of heat extraction by the upstream superheater section on the duct burner operation. The arrangement provides a downstream flow from the upstream SH section that is temperature stratified and positions the duct burner elements in the areas of maximum temperature. The tubes of the upstream superheater section and the duct burner elements are arranged in a variety of ways to provide temperature stratification, for example, in the horizontal or vertical directions.

14 Claims, 3 Drawing Sheets

TEMPERATURE STRATIFIED SUPERHEATER AND DUCT BURNER

This application is based on and claims the benefit of U.S. Provisional Patent Application Ser. No. 60/206,459, filed May 22, 2000.

BACKGROUND OF THE INVENTION

This invention relates generally to power generation system and, more particularly, to a heat recovery system in cogeneration plants.

Cogeneration plants often employ a duct burner placed in the turbine exhaust gas (TEG) upstream of a heat recovery steam generator (HRSG). The duct burner is disposed in a duct connecting the gas turbine to the HRSG. The fuel injected by the duct burner is oxidized by the oxygen present in the TEG stream. The use of the duct burner increases the overall capacity of the steam output from the HRSG and adds operational flexibility of the heat recovery system.

In a typical configuration of the duct burner, several horizontal lines of firing are provided by duct burner elements that are spaced uniformly in a vertical direction. Each duct burner element includes a gas header with flame stabilizers attached, or disposed adjacent, to the header. The duct burner assembly often includes baffles positioned between the duct burner elements. The primary function of the baffles is to increase the flow velocity around the duct burner elements. This increase in velocity is desirable, and may be necessary, for achieving the desired flame intensity and completeness of combustion. A secondary function of the baffles is to create an additional resistance that helps balance the TEG flow. Sometimes the baffles are used as structural members that via linkages support the duct burner elements. In a large system, the duct may have a cross section of about 30 feet wide by 50 feet high at the location of the duct burner. The duct burner may be composed of eight to twelve duct burner elements and a large number of baffles between the elements.

The duct connecting the gas turbine to the HRSG typically expands in cross-section with a steep slope at the top. The TEG flow has a very high level of turbulence and usually is poorly distributed across the duct. In order for the duct burner to perform effectively, improvements in the flow distribution are desired, especially in the vertical direction. In many cases the desired flow uniformity is achieved with the help of a distribution grid constructed across the duct. The grid performs a flow balancing action. Such grids are quite expensive as they are made of high grade stainless steel. The presence of the grid also causes detrimental pressure losses in the duct that reduce the efficiency of the turbine.

In some cases the HRSG includes a tubular superheater (SH) having an upstream SH section upstream of the duct burner and a downstream SH section downstream of the duct burner. Having a section of the SH unaffected by the duct burner has several benefits. The upstream SH section helps provide better control of steam temperature over the load range and lower peak temperatures of the SH tubes. The upstream SH section also helps improve the TEG flow distribution at the duct burner and allows the distribution grid to be eliminated or simplified. The superheater typically includes a plurality of SH tubes that are usually vertically disposed. The SH tubes may include fins extending from their surfaces into the TEG flow to increase heat extraction. Horizontal SH tubes may be used, but they are generally more difficult to support than vertical SH tubes.

Advances in gas turbine technology result in lower temperature and lower $O_2$ concentration in the turbine exhaust gas, placing greater demands on the duct burner. Extraction of heat from the TEG upstream of the duct burner further reduces the TEG temperature and exacerbates the problem. The use of the upstream SH section thus has a serious drawback by lowering the TEG temperature upstream of the duct burner. The lower TEG temperature coupled with lower oxygen concentration negatively impacts the duct burner performance (e.g., lower combustion efficiency, higher carbon monoxide and unburned hydrocarbon emissions). This typically necessitates the use of a more complicated and costly duct burner. In some cases the injection of fresh air (augmenting air) in the duct burner is needed for the duct burner operation, which can significantly increase burner cost and adversely affect the overall efficiency. Increased TEG temperature in the area of the duct burner flame would improve the duct burner performance and allow the use of simpler duct burners.

SUMMARY OF THE INVENTION

The present invention is directed to a heat recovery system in which the superheater and duct burner are arranged to provide improved performance. In preferred embodiments, the heat recovery system is a heat recovery steam generator (HRSG) including a superheater (SH) with an upstream SH section and a downstream SH section. The SH sections and duct burner are arranged to reduce the negative effects of heat extraction by the upstream SH section on the duct burner operation. The upstream SH section is arranged to provide a downstream flow that is temperature stratified and position the duct burner elements in the areas of maximum temperature, which may be as high as the temperature of the TEG upstream of the upstream SH section.

In one embodiment, the upstream SH section is disposed in the upper portion of the TEG duct connecting the gas turbine to the HRSG, while the duct burner elements are clustered in the lower portion of the duct. In this way, the duct burner elements are largely unaffected by the heat extraction from the TEG stream in the upper portion by the upstream SH section.

In another embodiment, the duct burner elements and the SH tubes of the upstream SH section are vertically disposed and alternately arranged in the horizontal direction to produce horizontal temperature stratification. In yet another embodiment, the duct burner elements and the SH tubes of the upstream SH section are horizontally disposed and alternately arranged in the vertical direction to produce vertical temperature stratification. In these arrangements, the effects of heat extraction from the TEG stream on the operation of the duct burner elements can be eliminated, or significantly reduced.

In yet another embodiment, the SH tubes of the upstream SH section are vertically disposed and the duct burner elements are horizontally disposed. The SH tubes have variable heat absorption in the vertical direction such that the heat extraction is lower adjacent the horizontally disposed duct burner elements, desirably much lower, than the heat extraction in regions between the duct burner elements. In this way, the temperature drop in the portion of the TEG flow adjacent the duct burner elements is minimized. Of course, an alternate configuration may employ horizontally disposed upstream SH tubes and vertically disposed duct burner elements.

In accordance with an aspect of the present invention, a heat recovery apparatus comprises a duct for receiving a flow of fluid in a flow direction. A heat extraction member is disposed inside the duct, and includes heat extraction elements for extracting heat from the flow of fluid. The heat extraction elements cover a heat extraction portion of a heat extraction cross section of the duct on which the heat extraction member is disposed. A duct burner is disposed inside the duct. The duct burner comprises duct burner elements disposed in a duct burner portion of a duct burner cross section of the duct on which the duct burner is disposed. The heat extraction portion when projected in the flow direction onto the duct burner cross section substantially does not overlap with the duct burner portion. The duct burner cross section is disposed downstream of (preferably immediately downstream of), or at the heat extraction cross section.

DESCRIPTION OF THE SPECIFIC EMBODIMENTS

Figure 1:
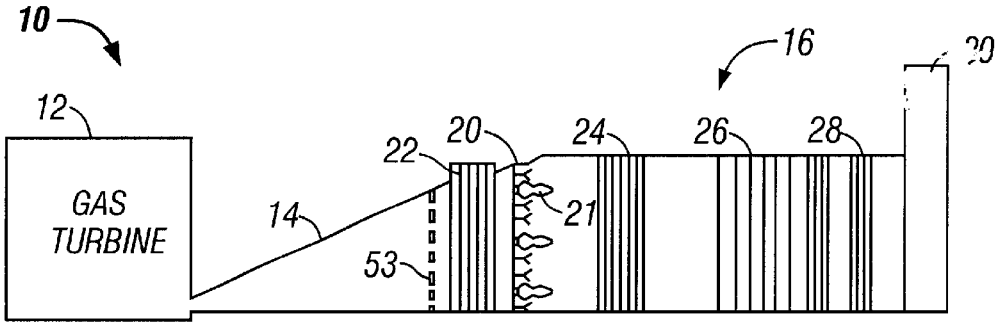
FIG. 1 is a schematic diagram of a power generation system including a gas turbine connected with an HRSG in accordance with an embodiment of the present invention.

FIG. 1 shows a power generation system 10 including a gas turbine 12 connected by an exhaust duct 14 to a heat recovery steam generator (HRSG) 16. A duct burner 20 is disposed in the duct 14. The duct burner 20 may be oil or natural gas fired, and serves to add heat to the turbine exhaust gas (TEG) flowing from the turbine 12 to the HRSG 16 when desired by the burning of additional fuel utilizing the unburned oxygen from the TEG and, in some arrangements, oxygen from fresh ventilation air. FIG. 1 illustrates flames 21 generated by the duct burner 20. The HRSG 16 has a plurality of heat exchanger surfaces including an upstream superheater (SH) section 22, a downstream SH section 24, a bank of evaporator tubes 26, and an economizer 28. The exhaust gas is emitted to the atmosphere via a stack 30. FIG. 1 also shows a distribution grid 53 that provides flow balancing upstream of the SH section 22. Note that FIG. 1 is a schematic diagram in which the components are not drawn to scale.

Figure 2:
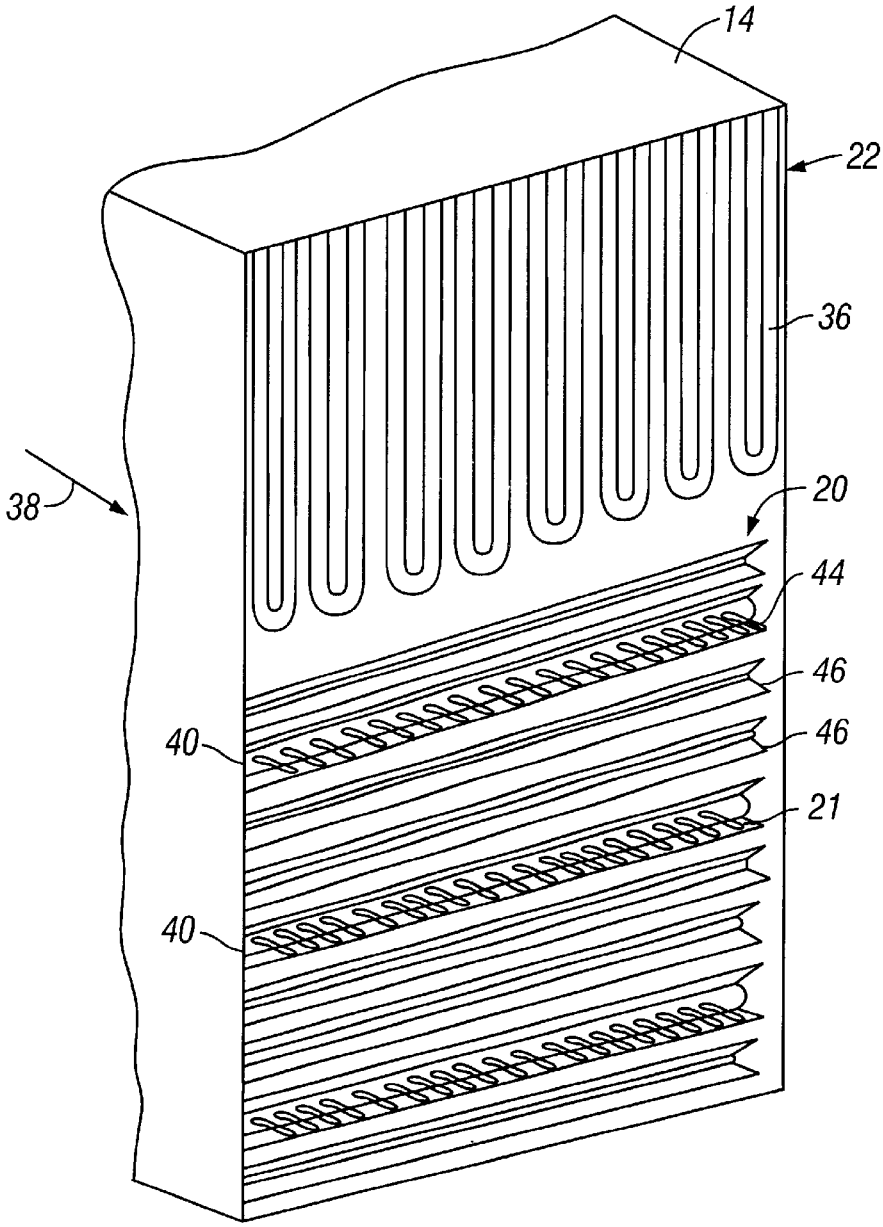
FIG. 2 is a simplified perspective view illustrating a first arrangement of the upstream superheater section and duct burner in the power generation system of FIG. 1.

FIG. 2 shows an embodiment of the upstream SH section 22 and duct burner 20. The upstream SH section 22 includes SH tubes 36 for extracting heat from the TEG flow through the duct 14 denoted by arrow 38. The SH tubes 36 are thus heat extraction or heat absorption elements. The SH tubes 36 desirably are vertically disposed, although they can alternately be horizontally disposed. Horizontal SH tubes 36 are typically more difficult to support than vertical SH tubes 36.

The duct burner 20 includes a plurality of duct burner elements such as fuel conduits 40 which include outlets such as nozzles through which fuel is flowed to generate the flames 21. The duct burner elements 40 are desirably horizontal, but may be vertical in alternate embodiments. Flame stabilizers 44 may be provided on both sides of the duct burner elements 40. Additional baffles 46 may also be provided between the duct burner elements 40. The primary function of the baffles 46 is to increase the flow velocity around the duct burner elements, which is desirable for achieving the desired flame intensity and completeness of the combustion. The baffles 46 also create an additional resistance that helps balance the TEG flow 38. Fewer or more baffles than shown in FIG. 2 may be employed. In some embodiments, the horizontal baffles 46 conveniently may be used as structural members to support the duct burner elements 40 via support linkages 42 (FIG. 2*a*).

Figure 2A:
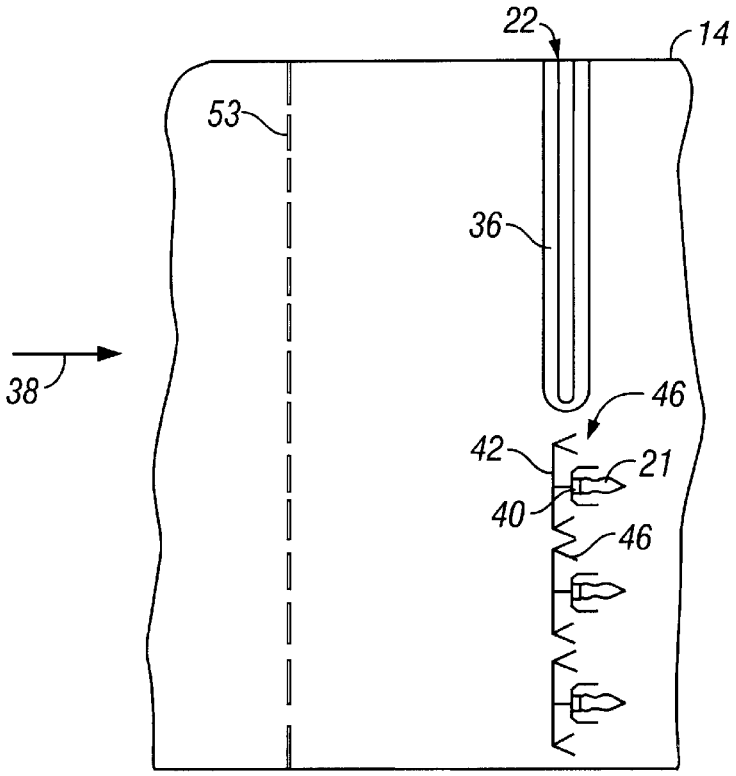
FIG. 2*a* is a simplified side elevational view of the first arrangement of FIG. 2.

As best seen in the side view of FIG. 2*a*, the upstream SH section 22 is disposed in the upper portion of the duct 14, while the duct burner 20 is disposed in the lower portion of the duct 14. The duct burner 20 and the upstream SH section 22 are typically disposed substantially in the same cross section without overlap. In this way, the duct burner elements 40 are largely unaffected by the heat extraction from the TEG stream 38 in the upper portion by the tubes 36 of the upstream SH section 22. Disposing the duct burner 20 along the same plane as, or immediately downstream of, the upstream SH section 22 is advantageous in maintaining high velocity and proper directionality and good distribution of the flow around the tubes and duct burner elements, increasing effectiveness of heat transfer, and improving duct burner performance. FIG. 2*a* also shows a distribution grid 53 for providing flow balancing upstream of the SH section 22 and duct burner 20.

One drawback of the arrangement of FIG. 2 is that it creates a substantially higher temperature non-uniformity in the vertical direction downstream of the duct burner 20, since the heat input from the duct burner 20 is biased toward the bottom portion of the duct 14. This vertical temperature non-uniformity negatively affects the HRSG performance and may slightly increase peak temperatures on the tubes of the downstream SH section 24 (FIG. 1).

Figure 3:
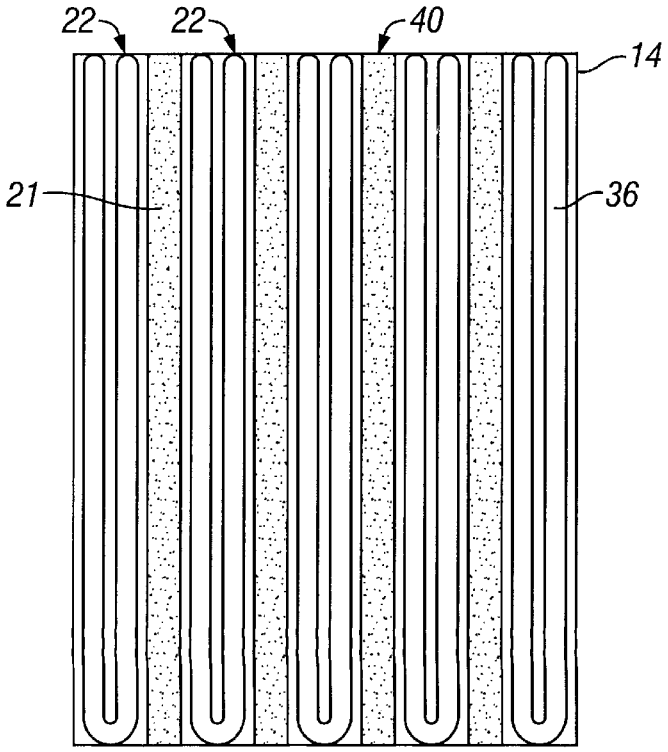
FIG. 3 is a simplified elevational upstream view illustrating a second arrangement of the upstream superheater section and duct burner in the power generation system of FIG. 1.

FIG. 3 is a simplified elevational view in an upstream direction illustrating a second arrangement of the upstream SH section 22 and duct burner 20. The upstream SH tubes 36 and the duct burner elements 40 are vertically disposed. The upstream SH tubes 36 and the duct burner elements 40 occupy discrete portions of the cross section of the duct 14. As used herein, the term "discrete portions" refer to portions that are discontinuous, including separate areas spaced from each other or areas having one or more holes defined therein. In FIG. 3, the duct burner elements 40 and the SH tubes 36 of the upstream SH section 22 are alternately arranged in the horizontal direction to produce horizontal temperature stratification. In this way, the duct burner elements 40 are largely unaffected by the heat extraction from the TEG stream 38 in different discrete portions by the tubes 36 of the upstream SH section 22. The duct burner elements 40 may be separated by 2–3 feet gaps in the horizontal direction. It should be noted that the temperature stratification can significantly reduce the negative heat extraction effect on the duct burner operation so that the cores of the flames 21 are virtually unaffected. The tails of the flames 21 are still affected as the stratified layers of the TEG flow at different temperatures (in the wake of the upstream SH section 22) eventually mix together. The effects of heat extraction on the tails of the flames can be minimized by properly sizing the spacing between the duct burner elements 40 using methods known in the art.

The arrangement of FIG. 3 may have some drawbacks. The horizontal temperature stratification causes higher horizontal temperature non-uniformity downstream of the duct burner 20. The non-uniformity is undesirable because different SH tubes in the downstream SH section 24, which are usually vertically disposed, will be exposed to different temperatures over substantially their entire lengths. This may cause overheating of those SH tubes in the path of high temperature flow portions, increasing the possibility of tube failure and reducing the overall effectiveness of the heat transfer. Thus, additional spacing between the duct burner 20 and the downstream SH section 24 may be needed for mixing to reduce the horizontal temperature non-uniformity, but it also requires a larger apparatus and raised costs. Another potential drawback relates to the vertical arrangement of the duct burner elements 40. It eliminates the flexibility of being able to adjust the fuel input in the vertical direction among different duct burner elements 40 sometimes used with horizontal arrangements to compensate for the predominantly vertical non-uniformity of the flow. Moreover, the vertical arrangement of the duct burner elements 40 places the service area of the duct burner 20 at the top of the duct 14, which may be less convenient for the operators (higher elevation and higher temperature at the top, as all the heat losses through the duct insulation are channeled by the buoyancy to the top).

Figure 4:
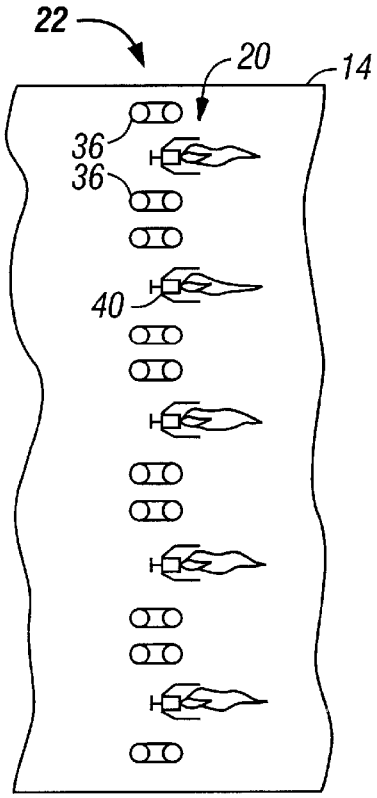
FIG. 4 is a simplified side elevational view illustrating a third arrangement of the upstream superheater section and duct burner in the power generation system of FIG. 1.

In FIG. 4, the duct burner elements 40 and the SH tubes 36 of the upstream SH section also occupy discrete portions in a manner similar to the arrangement of FIG. 3. In FIG. 4, however, the SH tubes 36 and the duct burner elements 40 are horizontally disposed and alternately arranged in the vertical direction to produce vertical temperature stratification.

The arrangement in FIG. 4 produces less non-uniformity in the heat extraction by different vertical tubes in the downstream section 24 of FIG. 1 than would result from the arrangements in FIGS. 2 and 3. One drawback of this arrangement is that it is difficult to support the horizontal SH tubes 36. Further, there may be higher non-uniformity of heat transfer from the TEG flow to the horizontal tubes in the upstream SH section 22 due to predominantly vertical non-uniformity of the flow velocity in the duct 14. The heat transfer non-uniformity may result in overheating in some of the SH tubes 36. The arrangements in FIGS. 2, 3, and 4 also allow reducing the number and size of the baffles 46, as the tubes 22 in these arrangements perform the function of the baffles.

Figure 5:
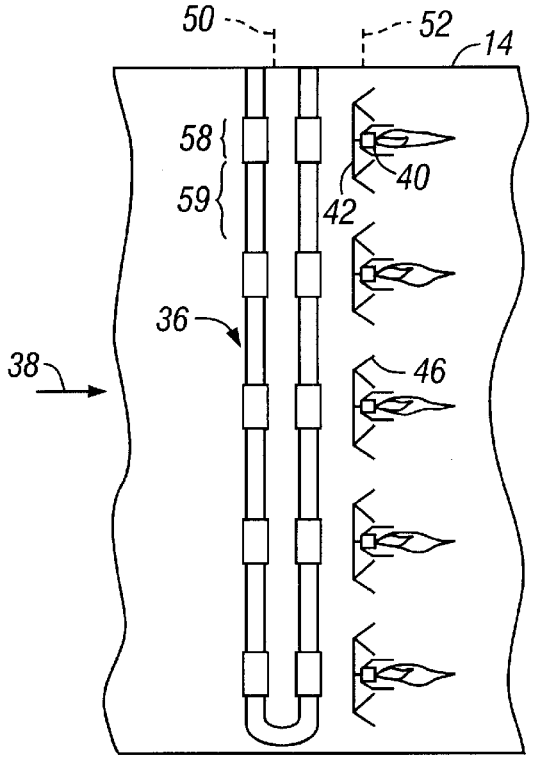
FIG. 5 is a simplified side elevational view illustrating a fourth arrangement of the upstream superheater section and duct burner in the power generation system of FIG. 1.

In the embodiment shown in the side view of FIG. 5, the SH tubes 36 of the upstream SH section 22 are vertically disposed and the duct burner elements 40 are horizontally disposed. The SH tubes 36 are disposed in an upstream SH cross section 50, and the duct burner elements 40 are disposed downstream in a duct burner cross section 52. The SH tubes 36 have variable heat absorption in the vertical direction with heat extraction segments 59 and reduced heat extraction segments 58. The heat extraction is lower in the reduced heat extraction portions 58 adjacent the horizontally disposed duct burner elements 40 than in the heat extraction segments 59. For example, the heat extraction by the reduced heat extraction segments 58 may be 20–70% of that in the heat extraction segments 59.

In addition, the alternating arrangement between the upstream SH tubes 36 and the duct burner elements 40 allows the baffles 46 to be positioned in regions at temperatures that are less than the average TEG flow temperature. This simplifies the design of the baffles and reduces the cost.

It should be noted that the desired reduction in heat absorption varies from case to case, depending on the specific turbine, HRSG, and operating regimes. Higher reduction in heat absorption is desirable in some cases, while no reduction is necessary in other cases. As shown in FIG. 5, when the heat extraction segments 59 of the SH tubes 36 are projected in the TEG flow direction 38 onto the duct burner cross section 52, they desirably do not overlap with the duct burner elements 40. The distance between the last layer of tubes 36 and the duct burner cross section 52 will be preferably less than 1–2 feet. Larger distances will cause some reduction in temperature stratification due to mixing.

Figure 6:
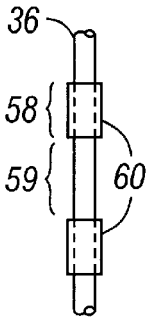
FIGS. 6–9 illustrate different embodiments of the details of the upstream superheater section in FIG. 5.
Figure 6A:
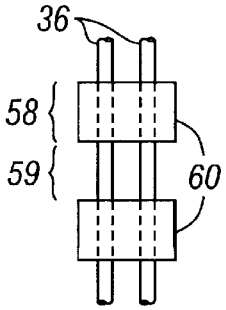
Figure 6B:
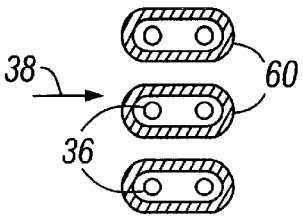
Figure 6C:
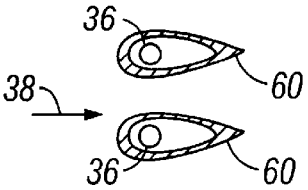
Figure 7:
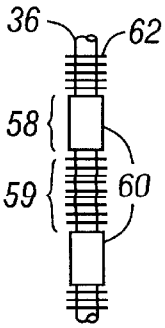
Figure 8:
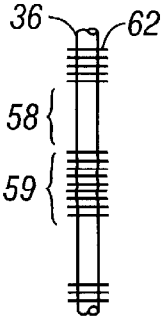
Figure 9:
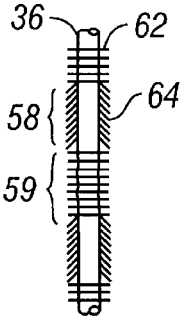

FIGS. 6–9 illustrate examples of the heat extraction segments 59 and reduced heat extraction segments 58 of the SH tubes 36. FIG. 6 shows insulating shields 60 in the reduced heat extraction segments to reduce heat extraction near the duct burner elements 40. The shields 60 may be designed to encompass several layers of tubes with one shield as shown in FIG. 6*a* (elevational view) and FIG. 6*b* (sectional view). The shields 60 may have an airfoil shape in another embodiment, as shown in FIG. 6*c*. Encompassing several layers of tubes with one shield or making airfoil shields will reduce unwanted losses of pressure in the duct 14. In FIG. 7, in addition to the shields 60 in the reduced heat extraction segments 58, the heat extraction segments 59 include heat absorption fins 62 to increase heat transfer. In further embodiments, the SH tubes 36 include the heat absorption fins 62 in the heat extraction segments 59 (FIG. 8), while the reduced heat extraction segments 58 have no fins or have folded fins 64 to reduce heat extraction (FIG. 9).

The length of the reduced heat extraction segments 58 is typically about 1–2 feet. The length may be smaller or greater, and can be determined on a case-by-case basis, depending on the oxygen concentration and temperature of the TEG stream, the performance capacity parameters of the duct burner 20, design of the shields, number of layers of tubes 36 with reduce heat absorption segments, and the like. With a typical temperature of the upstream TEG flow around 1100–1200° F., the shields 60 may be made of materials such as thin gauge stainless steel (e.g., #24GA, 304 SST) spaced about 0.5 inch away from the surface of the SH tubes 36. The shield reduces the radiation heat transfer and the air space between provides additional insulation. The shields 60 can reduce radiation heat transfer by about 50%, and convection heat transfer by about 80% with the overall reduction of about 70–80%.

The arrangement of the vertical SH tubes 36 and the horizontal duct burner elements 40 in FIG. 5 provides higher uniformity of heat transfer and temperature in both upstream and downstream sections of the HRSG 16 than those in FIGS. 2–4. Moreover, the reduced heat extraction segments in the horizontal direction allow the horizontal support structure for the horizontal duct burner elements 40 to be positioned in regions at relatively lower temperatures. This simplifies the design of the support structure and reduces the cost. One potential drawback is that a larger upstream SH section 22 (e.g., about 20–40% increase in size) is needed for extracting the same amount of heat due to the inclusion of reduced heat extraction segments 58. Nevertheless, the increase in cost of the larger superheater can be more than offset by the improved performance and reduced cost of the duct burner 20. Additional cost savings are achieved by further simplification or elimination of the distribution grid, because the improved uniformity with larger upstream SH section renders it less important to place a distribution grid 53 across the duct 14 to help improve flow uniformity.

The above-described arrangements of apparatus and methods are merely illustrative of applications of the principles of this invention and many other embodiments and modifications may be made without departing from the spirit and scope of the invention as defined in the claims. For instance, other arrangements to achieve temperature stratification, such as nonlinear stratification (i.e., other than solely horizontal stratification or solely vertical stratification), may be used. The scope of the invention should, therefore, be determined not with reference to the above description, but instead should be determined with reference to the appended claims along with their full scope of equivalents.

What is claimed is:

1. A heat recovery apparatus comprising:

a duct for receiving a flow of fluid in a flow direction;

a heat extraction member disposed inside the duct, the heat extraction member including heat extraction elements for extracting heat from the flow of fluid, the heat extraction elements being distributed over a heat extraction cross section of the duct on which the heat extraction member is disposed so as to occupy a heat extraction portion of the heat extraction cross section and to leave a remaining portion of the heat extraction cross section unoccupied by the heat extraction elements; and a duct burner disposed inside the duct, the duct burner comprising duct burner elements being distributed over a duct burner portion of a duct burner cross section of the duct on which the duct burner is disposed so as to leave a remaining portion of the duct burner cross section unoccupied by the duct burner elements, wherein the heat extraction portion when projected in the flow direction onto the duct burner cross section substantially does not overlap with the duct burner portion but overlaps with the remaining portion of the duct burner cross section unoccupied by the duct burner elements, wherein the duct burner cross section is disposed at least partially downstream of the heat extraction cross section.

2. The apparatus of claim 1 wherein the duct burner cross section is larger than the heat extraction cross section.

3. The apparatus of claim 1 wherein the heat extraction member comprises an upstream superheater section, the apparatus further comprising a downstream superheater section disposed downstream of the duct burner.

4. A heat recovery apparatus comprising:

a duct for receiving a flow of fluid in a flow direction;

a heat extraction member disposed on a heat extraction cross section inside the duct, the heat extraction member including heat extraction portions for extracting heat from the flow of fluid and reduced heat extraction portions for extracting substantially less heat from the flow of fluid than the heat extraction portions, the heat extraction portions and reduced heat extraction portions occupying different, non-overlapping areas of the heat extraction cross section; and a duct burner disposed on a duct burner cross section inside the duct, the duct burner comprising duct burner elements being disposed in and distributed over a duct burner portion of a duct burner cross section so as to leave a remaining portion of the duct burner cross section unoccupied by the duct burner elements, wherein the heat extraction portions when projected in the flow direction onto the duct burner cross section substantially do not overlap with the duct burner portion but overlaps with the remaining portion of the duct burner cross section unoccupied by the duct burner elements, wherein the duct burner cross section is disposed at least partially downstream of the heat extraction cross section.

5. The apparatus of claim 4 wherein the heat extraction member comprises a plurality of heat extraction tubes including heat extraction segments as the heat extraction portions and reduced heat extraction segments as the reduced heat extraction portions.

6. The apparatus of claim 5 wherein the reduced heat extraction segments are formed by covering the heat extraction tubes with insulating shields, and wherein the heat extraction segments have exposed surfaces without insulating shields.

7. The apparatus of claim 6 wherein at least some of the insulating shields each cover multiple layers of the heat extraction tubes.

8. The apparatus of claim 6 wherein at least some of the insulating shields have an airfoil shape oriented in the flow direction.

9. The apparatus of claim 5 wherein the heat extraction segments comprise a plurality of fins extending from the heat extraction tubes.

10. The apparatus of claim 9 wherein the reduced heat extraction segments comprise segments of the heat extraction tubes having no fins.

11. The apparatus of claim 9 wherein the reduced heat extraction segments comprise segments of the heat extraction tubes having folded fins.

12. A heat recovery apparatus comprising:

a duct for receiving a flow of fluid in a flow direction;

a heat extraction member disposed inside the duct, the heat extraction member including a plurality of heat extraction tubes vertically disposed in a heat extraction cross section of the duct, the heat extraction tubes including heat extraction segments for extracting heat from the flow of fluid and reduced heat extraction segments for extracting substantially less heat from the flow of fluid than the heat extraction segments, the heat extraction segments and reduced heat extraction segments occupying different, non-overlapping areas of the heat extraction cross section; and a duct burner disposed inside the duct, the duct burner comprising duct burner elements being disposed in and distributed over a duct burner portion of a duct burner cross section of the duct so as to leave a remaining portion of the duct burner cross section unoccupied by the duct burner elements, wherein the heat extraction segments when projected in the flow direction onto the duct burner cross section substantially do not overlap with the duct burner portion but overlaps with the remaining portion of the duct burner cross section unoccupied by the duct burner elements, wherein the duct burner cross section is disposed at least partially downstream of the heat extraction cross section.

13. The apparatus of claim 12 wherein the duct burner elements comprise fuel outlets spaced along a plurality of horizontal fuel conduits which are disposed in the duct burner cross section of the duct and which are vertically spaced from each other.

14. The apparatus of claim 13 wherein the reduced heat extraction segments of the heat extraction tubes include horizontal rows of segments in the heat extraction cross section of the duct corresponding to the horizontal fuel conduits in the duct burner cross section.

* * * * *

UNITED STATES PATENT AND TRADEMARK OFFICE

CERTIFICATE OF CORRECTION

PATENT NO. : 6,453,852 B1 
DATED : September 24, 2002
INVENTOR(S) : Vladimir Lifshits and Martin Joseph Fry It is certified that error appears in the above-identified patent and that said Letters Patent is hereby corrected as shown below:

Title page,
Item [73], please correct Assignee from "Corn Company, Inc." to
-- Coen Company, Inc. --

Signed and Sealed this

Fourth Day of February, 2003

JAMES E. ROGAN
*Director of the United States Patent and Trademark Office*